US005185926A

United States Patent [19]

Locke

[11] Patent Number: 5,185,926

[45] Date of Patent: Feb. 16, 1993

[54] MULTIPLE FOIL AND CUTTING BLADE ASSEMBLY FOR ELECTRIC DRY SHAVERS

[75] Inventor: David R. Locke, Bridgeport, Conn.

[73] Assignee: Remington Products, Inc., Bridgeport, Conn.

[21] Appl. No.: 832,419

[22] Filed: Feb. 7, 1992

[51] Int. Cl.[5] ..... B26B 19/02; B26B 19/12; B26B 19/06

[52] U.S. Cl. ..... 30/43.92; 30/43.9; 30/43.8

[58] Field of Search ..... 30/43.91, 43.92, 41.6, 30/346.51, 34.1, 43.1, 43.8, 43.9

[56] References Cited

U.S. PATENT DOCUMENTS

| | | | |
|---|---|---|---|
| 2,601,720 | 7/1952 | Carissimi | 30/43.92 |
| 2,611,175 | 9/1952 | Kobler et al. | 30/43.92 |
| 2,643,453 | 6/1953 | Carissimi | 30/43.92 |
| 2,696,665 | 12/1954 | Angst et al. | 30/43.92 |
| 2,734,266 | 2/1956 | Schreyer | 30/43.92 |
| 2,908,074 | 10/1959 | Kleinman | 30/43.92 |

*Primary Examiner*—Douglas D. Watts
*Assistant Examiner*—Paul M. Heyrana
*Attorney, Agent, or Firm*—Melvin I. Stoltz

[57] ABSTRACT

By providing at least three separate and independent foil members each of which cooperate with a separate and independent cutting blade system which is biased into engagement with the foil member and freely flexible in a plurality of directions, a substantially improved electric dry shaver is obtained. In the present invention, a unique cutting blade support assembly is provided which assures free flexible movement of the cutting blades, while also continuously and positively biasingly maintaining the cutting blades in contact with the foil member. In addition, the multiple foil construction of this invention provides a system wherein foil members having different physical characteristics are mountable to the shaver, thereby providing substantially enhanced cutting capabilities and more universal applicability to unusual or mixed shaving conditions.

19 Claims, 6 Drawing Sheets

FIG. 10
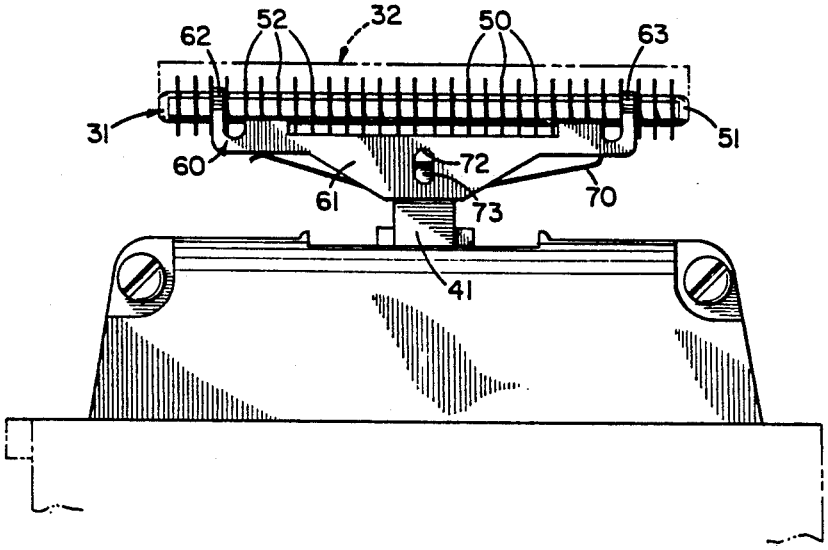
FIG. 11
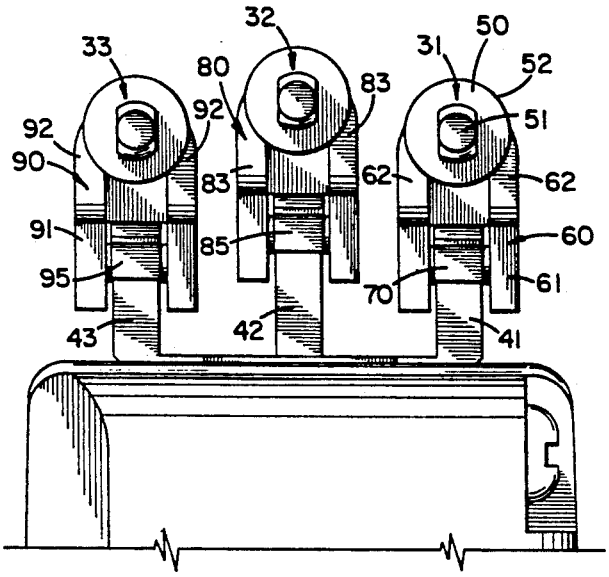
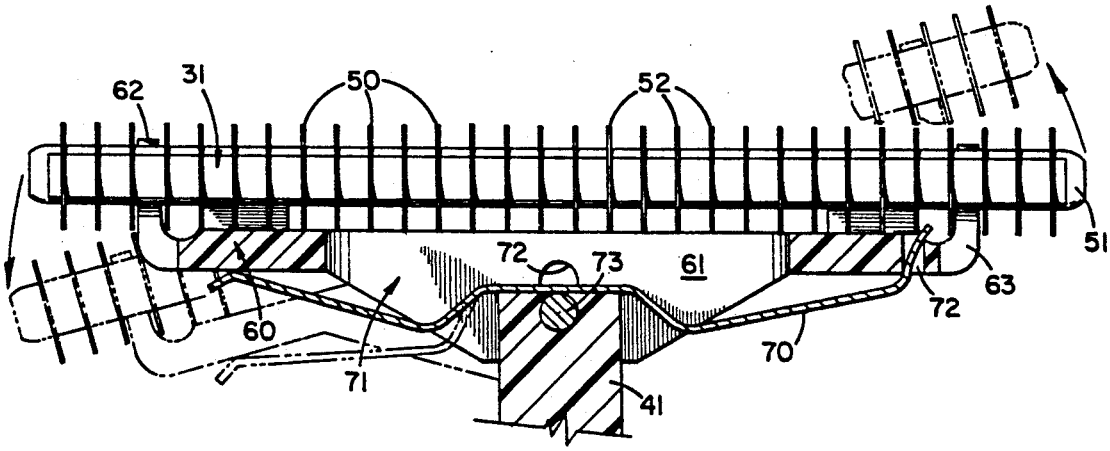
FIG. 12

MULTIPLE FOIL AND CUTTING BLADE ASSEMBLY FOR ELECTRIC DRY SHAVERS

TECHNICAL FIELD

This invention relates to electric dry shaver and, more particularly, to improved cutting systems for shavers having at least three separate and independent cutting assemblies.

BACKGROUND ART

Over the last several years, both men and women have been increasingly drawn to the advantages provided by electric dry shavers. In general, the consuming public has found that the use of razors or other systems is extremely inconvenient for removing or shaving short hair or stubble, as commonly found in mens' beards and womens' legs. In addition, with the ever increasing time constraints and commitments individuals typically encounter, a fast and effective shaving system is most desirable.

The discomfort as well as the time consumed in using shaving cream, soaps and gels in order to provide a medium for which a razor can be used, requires more time and inconvenience than most individuals are willing or capable of allowing. Furthermore, the cost of maintaining a sufficient supply of these products creates an additional burden. Consequently, electric dry shavers have become increasingly popular, as well as battery operated electric dry shavers which can withstand exposure to moisture, thereby enabling individuals to simultaneously shower as well as shave either beards or legs.

As the popularity of electric dry shavers increased, various product designs and alternate constructions proliferated, in an attempt to improve and enhance the comfort and cutting efficiency of such shavers. However, in spite of these product changes, difficulties have continued to exist in providing optimum results with optimum comfort.

One particular configuration has been found to be extremely efficacious in achieving high quality shaving results, as well as being extremely comfortable to use. This configuration comprises the various models of electric dry shavers incorporating a movable cutting blade which cooperates with a thin, flexible mesh screen, or apertured foil.

In operation, the cutting blades are rapidly and continuously reciprocatingly moved against one side of the mesh screen or apertured foil, causing the cutting blades to repeatedly cross the plurality of apertures and provide a virtually continuous cutting action at each aperture. Then, by sliding or guiding the other side of the mesh screen or apertured foil over the skin surface to be shaved, the individual hair shafts enter the holes formed in the screen or foil and are cut by the movement of the cutting blades.

Although this dry shaving cutting system has proven to be extremely effective, as compared to other dry shaving products, one area of difficulty does exist. In certain instances, as the mesh screen or apetured foil is moved over the skin surface in order to attain the desired cutting action, the contours of the skin act upon the apertured foil and cause the foil to deflect in various directions. Since the cutting blades are in intimate contact with the opposed side of the apertured foil, the deflection of the foil also causes the cutting blades to be simultaneously deflected therewith.

Unfortunately, at certain times, the apertured foil and the cutting blades do not simultaneously move in completely identical directions and, as a result, the cutting blade is moved out of intimate, contacting, cutting engagement with at least a portion of the surface of the apertured foil. When any such separation occurs, the movement of the cutting blade is incapable of attaining the requisite cutting action against the surface of the apertured foil, causing discomfort to the user.

In an attempt to eliminate this difficulty, most prior art electric dry shavers have mounted the cutting blade assembly in combination with spring means in order to continuously urge the cutting blade assembly into contact with the surface of the apertured foil. Conceptually, this construction was to continuously retain the cutting blade in contact with the apertured foil, regardless of the deflection of the apertured foil and cutting blade assembly during use.

Unfortunately, this prior art construction has been found to be incapable of eliminating the problem. Typically, the cutting blade assembly is constructed as an integral unit and continues to move as a unit. Consequently, under certain circumstances, portions of the surface of the apertured foil become separated from the cutting blades during use. This causes unshaven areas to continue to exist.

In addition, prior art shavers typically employ a single type of apertured foil which best satisfies the needs of users most of the time. However, prior art systems are incapable of providing different hole patterns, or foil constructions on the same shaver. As a result, enhanced comfort and improved shaving capabilities are not attained, and less frequent conditions, such as longer hairs or mixed long and short hairs are not able to be adequately handled.

Consequently, it is a principal object of the present invention to provide an enhanced cutting system for electric dry shavers whereby unwanted disassociation of the cutting blade from the mesh screen or apertured foil is prevented.

Another object of the present invention is to provide an enhanced cutting system for electric dry shavers having the characteristic features described above which is capable of providing a plurality of different hole patterns in a single shaver, thereby substantially improving comfort and shaving efficiency, while also providing enhanced and improved results.

Another object of the present invention is to provide an enhanced cutting system for electric dry shavers having the characteristic features described above which is capable of virtually eliminating areas where the shaver is incapable of cutting the desired hair due to the contours of the surface being shaved, or the composition or length of the hair.

A further object of the present invention is to provide an enhanced cutting system for electric dry shavers having the characteristic features described above which virtually eliminates unwanted unshaven areas.

Other and more specific objects will in part be obvious and will in part appear hereinafter.

SUMMARY OF THE INVENTION

By employing the present invention, all of the prior art difficulties and drawbacks have been completely eliminated and a substantially improved, close and comfortable shaving assembly is attained. Furthermore, by employing the present invention, a plurality of alternate foil constructions are employed in a single electric shaver providing the user with a cutting assembly specifically designed for attaining a greater range of shaving conditions. In addition, the present invention assures continuous intimate contact between the cutting blades and the apertured foil.

In the present invention, a plurality of independent or separately constructed cutting blade assemblies and apertured foils are employed to achieve a single cutting assembly for the electric shaver. In the preferred embodiment, at least three separate and independent foil members and three separate and independent cutting blade assemblies are employed to achieve the substantially improved and enhanced close cutting and shaving results. In this way, the foil members employed are able to, in a single shaver, comprise different apertures for providing improved shaving results under different conditions. Consequently, a single shaver is now attained which is easily able to handle all shaving problems easily and efficiently.

In addition, by employing the present invention, the apertured foil can be mounted in the shaver with different radii of curvatures, with the cutting blade assemblies having corresponding, matching diameters so as to provide the desired cooperating, enhanced cutting action. In this way, the overall shaving surface is now able to be constructed with specific zones specially designed for handling a particular shaving problem, resulting in a shaver having an optimum construction and a substantially enhanced cutting system.

In the preferred embodiment, the multiple foil and cutting blade assemblies of the present invention also comprise a construction wherein each of the separate and independent cutting blade assemblies are mounted for articulatable movement in virtually every alternate direction, as well as in biased interengagement with each other. The cutting blade assemblies are constructed for being reciprocally driven along their central axis, by conventional drive means, while also being constructed for pivoting movement about an axis perpendicular to the central axis of the drive means of the cutting blade assembly. Preferably, each cutting blade assembly is able to move above this pivot axis through an arc ranging between about 15° and 70°.

Furthermore, in the preferred embodiment, each cutting blade assembly is independently spring biased to be maintained in its uppermost position, maintaining the cutting edges of the blades in direct sliding frictional contact with the inside surface of the foil member with which the cutting blade cooperates. In addition, each separate and independent cutting blade assembly is also movable along an axis perpendicular to its pivot axis. In this way, each blade assembly is maintained in biased contacting engagement with its foil member, while also being movably deflectable along with any movement of the foil member.

By employing this construction, a unique multiple foil and multiple cutting blade assembly is attained. In this invention, each separate foil member is cooperatingly interengaged with a separate and independent elongated cutting blade assembly, which is spring biased into frictional interengagement therewith, while also being capable of translational and arcuate pivoting motion relative thereto. As a result, as the electric shaver is employed and the surfaces of the multiple foil members are moved along the surface being shaven, the multiple foil and multiple cutter assemblies incorporated therein are capable of maintaining contacting relationship with each other, regardless of the contours over which the foil surfaces pass. In addition, the spring biased construction also continuously urges and maintains the cutting blades of each of the independent cutting blade assemblies in continuous, sliding, frictional, contacting interengagement with the cooperating foil member, assuring that disconnection of the cutting blade from the foil is prevented and a smooth, clean, comfortable shaving result is achieved.

The invention accordingly comprises the features of construction, combinations of elements and arrangement of parts which will be exemplified in the constructions hereinafter set forth and the scope of the invention will be indicated in the claims.

THE DRAWINGS

For a fuller understanding of the nature and objects of the present invention, reference should be had to the following detailed description, taken in connection with the accompanying drawings, in which:

FIG. 10 is a side elevational view showing the cutting blade assemblies of the present invention in position mounted on the shaver of FIG. 3;

FIG. 11 is a side elevation view of the fully assembled cutting blade assemblies as depicted in FIG. 10;

FIG. 12 is a side elevation view, partially in cross section, of one fully constructed cutting blade assembly shown mounted to its support post, depicting its pivoting capabilities;

DETAILED DESCRIPTION

Figure 1:
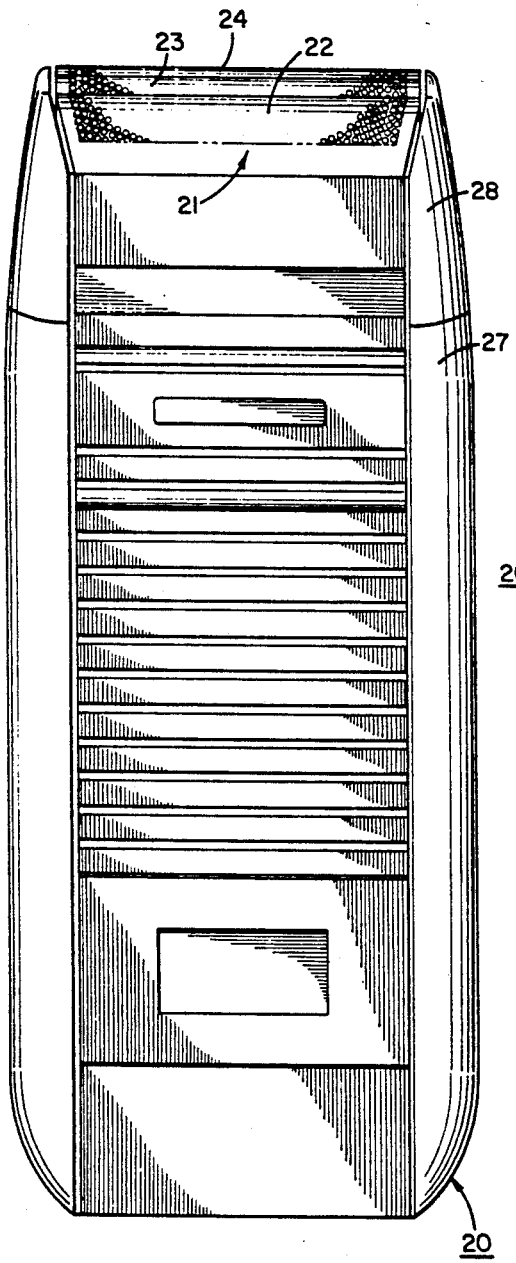
FIG. 1 is a front elevation view of one embodiment of a fully assembled shaver incorporating the multiple foil and multiple blade assemblies of the present invention.

In FIG. 1, an electric dry shaver is depicted incorporating the multiple foil and multiple independent cutting blade assemblies of the present invention. For purposes of providing a complete detailed disclosure, without intending to be limited thereby, the drawings and the following detailed disclosure describe the present invention in association with an electric dry shaver constructed for shaving beards. However, as is apparent to one of ordinary skill in the art, the multiple foil construction and multiple blade assembly system of this invention is equally applicable to any electric dry shaver, whether the shaver is employed for males or females. Consequently, the scope of protection afforded by the improved cutting system of this invention is not intended to be limited to the specific type of shaver depicted and is specifically intended to be equally applicable to all electric dry shaver constructions.

In FIGS. 1 and 21, electric dry shaver 20 is depicted incorporating one embodiment of the improved cutting system 21 of the present invention. In this embodiment, cutting system 21 incorporates three separate and independent foil members, 22, 23, and 24. In addition, a separate and independent cutting blade assembly is associated with each of the three foil members, thereby providing the substantially improved and enhanced close shaving capabilities.

Figure 2:
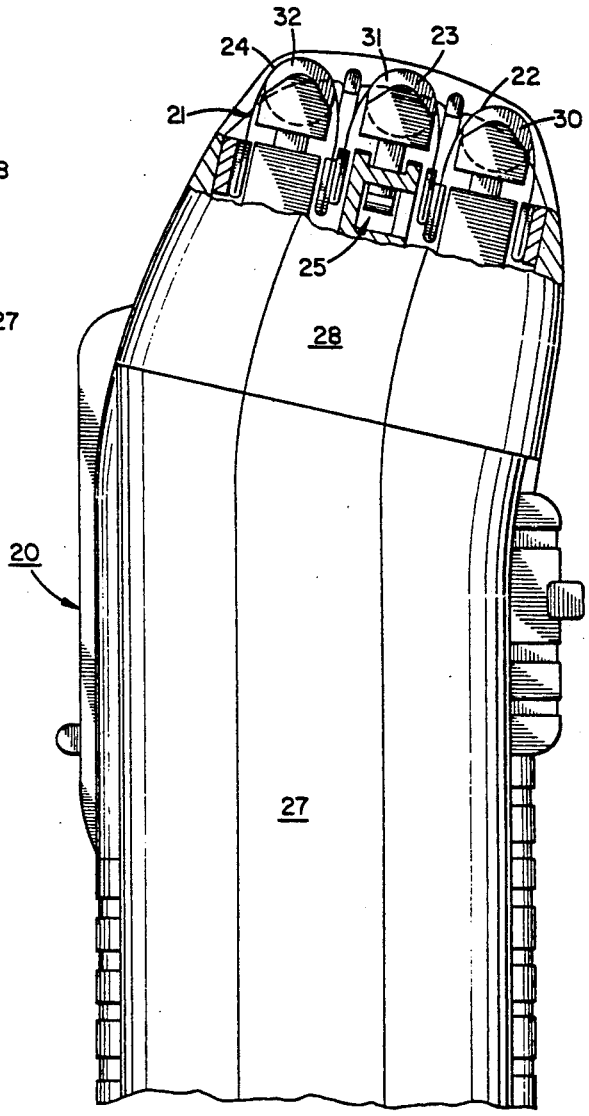
FIG. 2 is a side elevation view, partially in cross-section and partially broken away of the shaver of FIG. 1.
Figure 3:
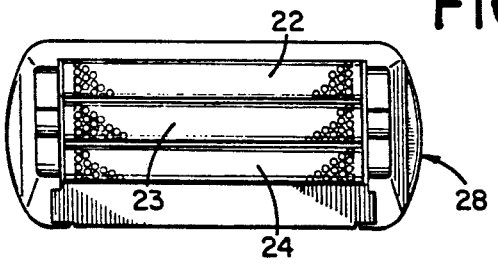
FIG. 3 is a top plan view of an alternate embodiment of a fully assembled electric shaver incorporating the multiple foil and multiple cutting blade assemblies of the present invention.
Figure 4:
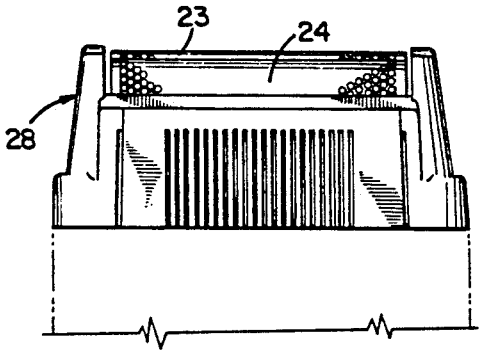
FIG. 4 is a side elevation view, partially broken away, showing the electric shaver of FIG. 3.
Figure 5:
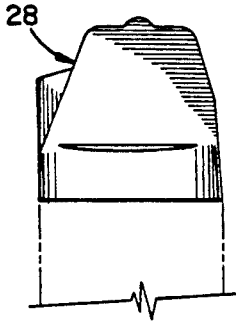
FIG. 5 is a side elevation view of the electric shaver of FIG. 3.

As shown in FIGS. 1 and 2, electric dry shaver 20 comprises a housing 27 to which guard/cover support base 28 is removably mounted. In the conventional manner, housing 21 incorporates a motor (not shown) which incorporates a control pin (not shown) interconnected with cutting blade system 25. This construction causes each of the three independent blade cutting assemblies to move in the desired, side-to-side, reciprocating manner, in contacting interengagement with the inside surface of one of the foil members. Preferably guard/cover support base 28 is constructed for telescopic, overlying, locking, interengagement with housing 27, in order to enable access to the hair pocket for cleaning and gaining access to the cutting blades and the foil members 22, 23 and 24, when required.

In the embodiment of this invention depicted in FIG. 2, each of the foil members 22, 23 and 24 are individually and independently mounted to guard/cover support base 28. In this way, as is further detailed below, a combination of alternate foil constructions can be employed in order to attain a precisely desired type of shaving, or a more universal shaving capability. In this regard, foil members of different thicknesses and foil members with different hole patterns can be quickly and easily positioned in any desired location on guard-/cover support base 28. As a result, a precisely constructed cutting action can be provided or tailor-made for achieving a particularly desired result.

As shown in FIG. 2 and further detailed below, cutting blade system 25 incorporates, in this embodiment, three separate and independent blade assemblies 30, 31, and 32. As depicted, blade assembly 30 is in frictional interengagement with foil member 22, while blade assembly 31 frictionally contacts foil member 23, with blade assembly 32 being maintained in reciprocating, sliding, frictional interengagement with foil member 24. By employing this construction, separate and independent blade assemblies 31, 32, and 33 are maintained in cooperating, sliding, frictional cutting interengagement with the inside surface of foil member 22, 23 or 24, respectively. As a result, the substantially improved and greatly enhanced cutting capability and comfort realized by the present invention is attained.

In FIGS. 3–8, one preferred embodiment is shown for securely retaining and removably mounting foil members 22, 23 and 24 in guard/cover support base 28. For purposes of clarity the guard/cover support base 28 depicted in FIGS. 3–7 comprises a support base which is vertically mounted to the housing, instead of angularly mounted to a shaver housing as depicted in FIGS. 1 and 2.

Figure 6:
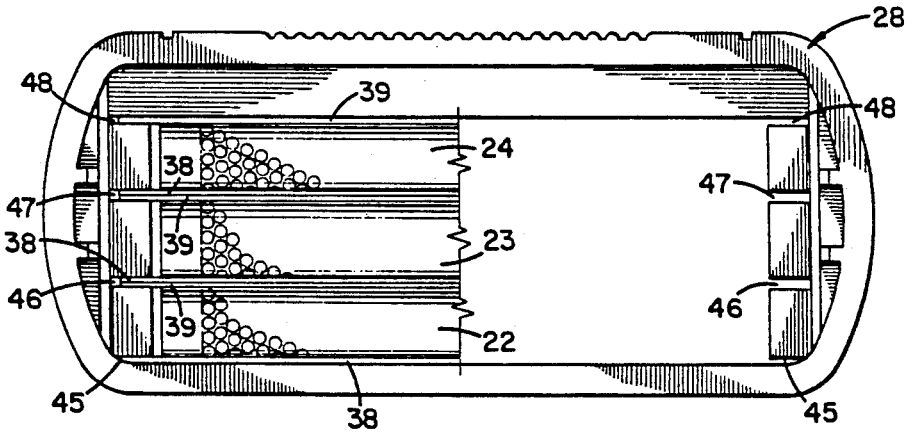
FIG. 6 is a bottom plan view, greatly enlarged and partially broken away, showing the foil supporting housing of the shaver of FIG. 3 removed from the shaver, with a portion of the foil members shown broken away, depicting the foil members in secure, locked interengagement therewith, as well as removed therefrom.
Figure 7:
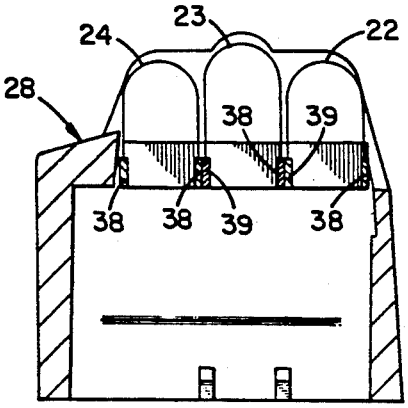
FIG. 7 is a cross-sectional, side elevation view of the foil holding housing of FIG. 6 with the foil members mounted in place.

As best seen in FIGS. 6 and 7, in this embodiment, each of the foil members 22, 23 and 24 terminate at one end with an elongated end plate 38, and at the opposed end with end plate 39. This construction is typically employed with prior art foil members in order to provide a reinforced terminating edge and a mounting surface for positioning the foil member in a precisely desired location. In addition, as shown in FIG. 6, each of the end plates 38 and 39 mounted to each of the foil members 22, 23 and 24 extend beyond the terminating side edge of the foil member, in order to provide an extension surface by which the foil members can be securely retained in the precisely desired location.

Figure 8:
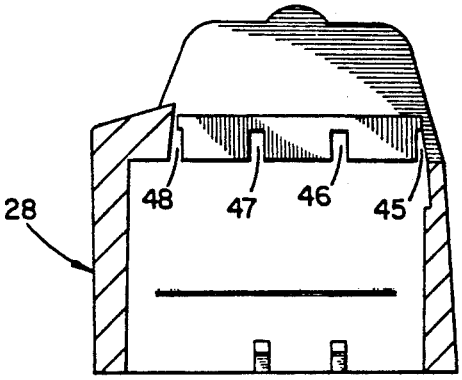
FIG. 8 is cross-sectional, side elevation view of the foil holding housing of FIG. 6 shown with the foil members completely removed.

As depicted in FIGS. 6 and 8, a plurality of slots are formed in guard/cover support base 28 for receiving and securely maintaining end plates 38 and 39 of each of the foil members in the desired position. As shown, guard/cover support base 28 incorporates elongated slots 45, 46, 47, and 48 formed in juxtaposed, spaced, facing relationship along the inside edge surfaces of guard/cover support base 28.

By employing this embodiment of the present invention, each of the foil members 22, 23 and 24 is quickly and easily separately positioned in secure retained engagement with guard/cover support base 28 by placing end plates 38 and 39 of each foil members in the slots corresponding to the precisely desired position for that foil member. As shown in FIGS. 6 and 7, foil member 22 is placed in secure mounted interengagement with guard/cover support base 28 by positioning end plate 38 in elongated slot 45 of base 28, while opposed end plate 39 is positioned in slot 46 of base 28.

Then, in this embodiment, foil member 23 is securely affixed to support base 28 by positioning its end plate 38 in slot 46, adjacent plate 39 of foil member 22, while positioning its opposed end plate 39 in slot 47 of base 28. Finally, foil member 24 is securely mounted in position by placing end plate 38 of foil member 24 in slot 47, adjacent plate 39 of foil member 23, with the opposed end plate 39 of foil member 24 being mounted in slot 48 of base 28. Once mounted in these precisely desired positions, foil members 22, 23 and 24 are all in the precisely desired secure position ready for being mounted to the shaver for cooperative interengagement with their respective blade assemblies.

In the preferred embodiment, each of the elongated slots 45, 46, 47 and 48 are all dimensioned to accommodate the thickness of the end plates positioned therein. Consequently, slots 46 and 47 comprise a width substantially greater than slots 45 and 48, since slots 46 and 47 securely retain two end plates therein.

As in apparent from this detailed disclosure, foil members 22, 23 and 24 may comprise any desired thickness or hole pattern in order to provide a final assembly especially designed for achieving a particular shaving effect. In this way, all varying types of beards, as well as varying hair lengths, can be accommodated quickly and easily by merely placing a foil member capable of achieving a desired result in support base 28. In this way, the electric shaver of the present invention is substantially more versatile than conventional prior art constructions and greater flexibility and enhanced use and comfort are realized.

In addition, by employing this invention, foil members of different lengths and foil members having different radii of curvature can be easily intermixed. As shown in FIG. 7, foil member 23 comprises an overall length greater than foil members 22 and 24, in order to enable the centrally positioned foil and blade assembly to be at a level higher than the surface of the other two blade cutting surfaces. Furthermore, the radius of curvature employed for foil members 22 and 24 differ from the radius of curvature of foil member 23, with the radius of curvature of foil member 23 being smaller than the radii of curvature of the other two foil members. In this way, different cutting characteristics are attained and a more precise, thorough cutting action is realized.

In FIGS. 9–13, one preferred embodiment of improved cutting system 21 of the present invention is depicted in detail. As shown therein, improved cutting system 21 incorporates foil members 22, 23 and 24 and reciprocatingly mounted, multiple blade supporting system 25.

In this embodiment, multiple blade supporting system 25 comprises three separate and independent blade assemblies 31, 32 and 33. Each of the blade assemblies are mounted to an upstanding drive pin 40 which comprises three separate and independent upstanding support posts 41, 42 and 43. As is well known in the art, drive pin 40 is directly connected to the drive motor for causing drive pin 40 to continuously move back and forth, in a reciprocating manner, causing multiple blade supporting system 25 to move therewith, providing the desired sliding frictional cutting interengagement between multiple blade system 25 and foil members 22, 23 and 24.

In this preferred embodiment, blade assembly 31 comprises a plurality of independent, identically shaped cutting blades 50, each of which are aligned in juxtaposed, spaced, parallel facing relationship with each other. In order to securely maintain each cutting blade 50 in the desired, aligned, spaced relationship, cutting blades 50 are securely affixed to each other by an elongated holding rod 51 extending through each of the cutting blades 50 forming blade assembly 31. In this way, cutting blades 50 are securely affixed and maintained in the precisely desired, aligned position.

In the preferred embodiment, each cutting blade 50 comprises a substantially circular shape, with the outer peripheral edge thereof forming a cutting edge 52. As detailed above, the cutting edges 52 of blade assembly 31 are positioned in sliding, contacting, frictional interengagement with foil member 22, thereby providing the desired cutting action.

Similarly, blade assembly 32 comprises a plurality of cutting blades 53, positioned in juxtaposed, spaced, parallel, facing, aligned relationship with each other, with each of the cutting blades 53 securely maintained in the desired aligned relationship by mounting cutting blades 53 to holding rod 54. In addition, each of the cutting blades 53 comprise an outer peripheral surface forming cutting edge 55 which, when fully assembled, is maintained in sliding, frictional, interengagement with foil member 23.

Finally, in this embodiment, blade assembly 33 comprises a plurality of cutting blades 56 mounted in aligned, spaced, parallel relationship with each other on elongated holding rod 57. In addition, each of the cutting blades 56 comprises a cutting edge 58 which, when fully assembled, is maintained in sliding, contacting, frictional interengagement with foil member 24.

In order to securely maintain and supportingly hold blade assembly 31 in the desired position with foil member 22, blade assembly 31 is mounted in secure, holding, interengagement with blade assembly support member 60. In the preferred construction, blade assembly support member 60 comprises an elongated support base 61 to which is mounted a first pair of juxtaposed, spaced, facing, upstanding fingers 62—62 at one end thereof and a second pair of holding fingers 63—63 mounted at the opposed end of support base 61.

In the preferred embodiment, upstanding fingers 62—62 and 63—63 are constructed for peripherally surrounding and securely engaging elongated holding rod 51 of blade assembly 31. In this way, blade assembly 31 is securely maintained in an upstanding position ready for reciprocating movement along the axis defined by holding rod 51.

In order to assure and provide the desired cutting efficiency and continuous close cutting contacting interengagement between blade assembly 31 and foil member 22, blade assembly support member 60 is constructed for arcuate movability about support post 41, while also comprising spring biasing means to continuously urge and maintain blade assembly 31 in continuous contacting engagement with the inside surface of foil member 22. In this way, as the top surface of foil member 22 is moved over the surface to be shaven, the irregularities of that surface and the deflections of foil member 22 do not cause blade assembly 31 to become dislodged or moved away from cutting engagement with foil member 22.

By constructing blade assembly support 60 in the manner detailed herein, inherent flexibility, pivotability and spring biased interengagement is provided. Furthermore, blade assembly 31 acts completely independently of blade assemblies 32 and 33, responding only to the movement of foil member 22. In this way, assurance is provided that blade assembly 31 moves completely and totally independently of any movement caused by the other foil members or the other cutting blade assemblies.

In order to provide the desired independent blade assembly flexibility, blade assembly support member 60 incorporates an elongated spring member 70, which preferably comprises an elongated leaf-spring construction. In this preferred embodiment, support member 60 also incorporates a cavity 71 centrally disposed in support base 61, within which a major portion of leaf-spring 70 is maintained.

As best seen in FIG. 12, the preferred construction of this embodiment maintains one end of leaf-spring 70 in secure, locked interengagement within receiving hole 72 formed in base 61 of support member 60, with the opposed end of leaf-spring 70 moving freely along the bottom surface of support base 61. By employing this construction, elongated spring member 70 biasingly forces the opposed, cantilevered blade assembly ends of support base 61 upwardly, while also providing support base 61 of support member 60 with the desired flexibility and movability.

The construction of blade assembly support member 60 is completed by incorporating therein an elongated pin-receiving slot 72, extending through support base 61, passing completely through support base 61 and being formed on both sides of cavity 71. In this way, movability of support member 60 relative to the axis of post 41 is attained.

Blade assembly support member 60 is securely mounted to support post 41, for providing the desired reciprocating movement, by positioning support post 41 in cavity 71 and securely mounting support member 60 to post 41 by positioning an elongated locking pin 73 through pin-receiving slot 72 of support member 60 with locking pin 73 fixedly mounted in post 41. In this way, the reciprocating movement of drive pin 40 and support post 41 causes support member 60 to move in the identical direction therewith, causing blade assembly 31 to move in the desired reciprocating side-to-side manner.

Figure 13:
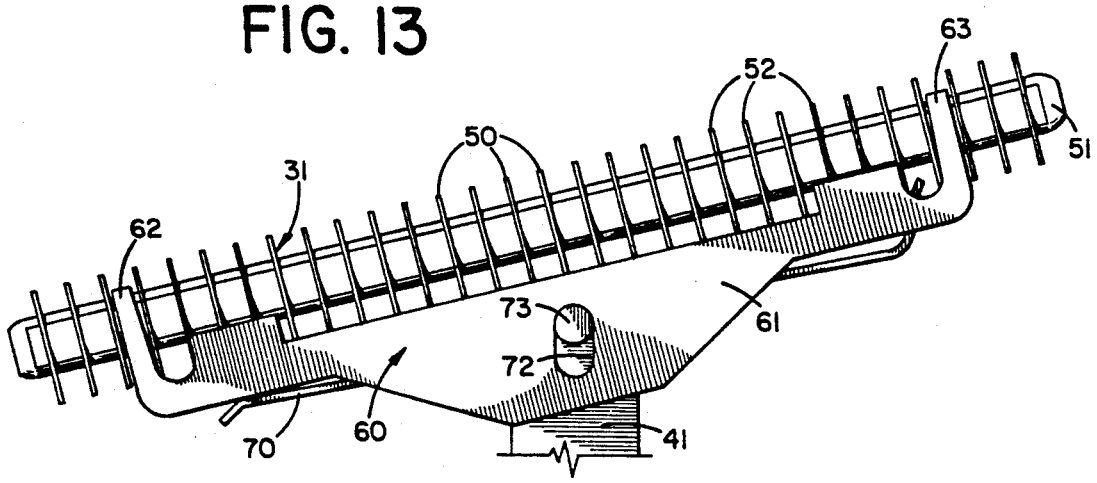
FIG. 13 is a side elevation view of one cutting blade assembly mounted in position, as depicted in FIG. 12 further depicting the movability of the cutting assembly.

As best seen in FIGS. 12 and 13, the construction detailed above provides blade assembly 31 with complete, independent movability in a plurality of axes. In particular, elongated leaf-spring 70 continuously maintains an upward, spring biasing force on the cantilevered arms of base 61 of support member 60. As a result, blade assembly 31 is continuously biased upwardly into contact with foil member 22.

In addition, blade assembly 31 and support member 60 are capable of arcuate pivotability about the axis defined by pin 73, with elongated spring member 70 continuously biasing support member 60 and blade assembly 31 back to its normal position. In FIG. 12, the arcuate movement of blade assembly 31 and support member 60 about the central axis of pin 73 is clearly depicted showing blade assembly 31 being able to pivot through an arc of between about 15° to 70°.

In addition, since pin receiving slot 72 comprises an elongated construction, blade assembly support member 60 and blade assembly 31 mounted thereto are capable of vertical movement, along the axis of upstanding support post 41 and substantially perpendicular to the axis of locking pin 73. This vertical movement of blade assembly 31 and support member 60 along the central axis of support posts 41 is depicted in FIGS. 12 and 13. As with the arcuate pivotability, elongated spring 70 continuously biases and returns support member 60 and blade assembly 31 to its original position, as depicted in FIG. 10.

As is apparent from this detailed disclosure, this construction provides a unique, independent, biasing contacting interengagement between the cutting blades of blade assembly 31 and apertured foil member 22, assuring that cutting blades 50 of blade assembly 31 are continuously maintained in sliding, frictional, cutting interengagement with foil member 22, regardless of the flexure of foil member 22 during use. In order to assure that each of the other blade assemblies 32 and 33 also possess the same arcuate pivotability and vertical movability as blade assembly 31, blade assembly support members 80 and 90 are constructed and mounted to their respective support posts in the identical manner as detailed above in reference to support member 60 and post 41.

Figure 9:
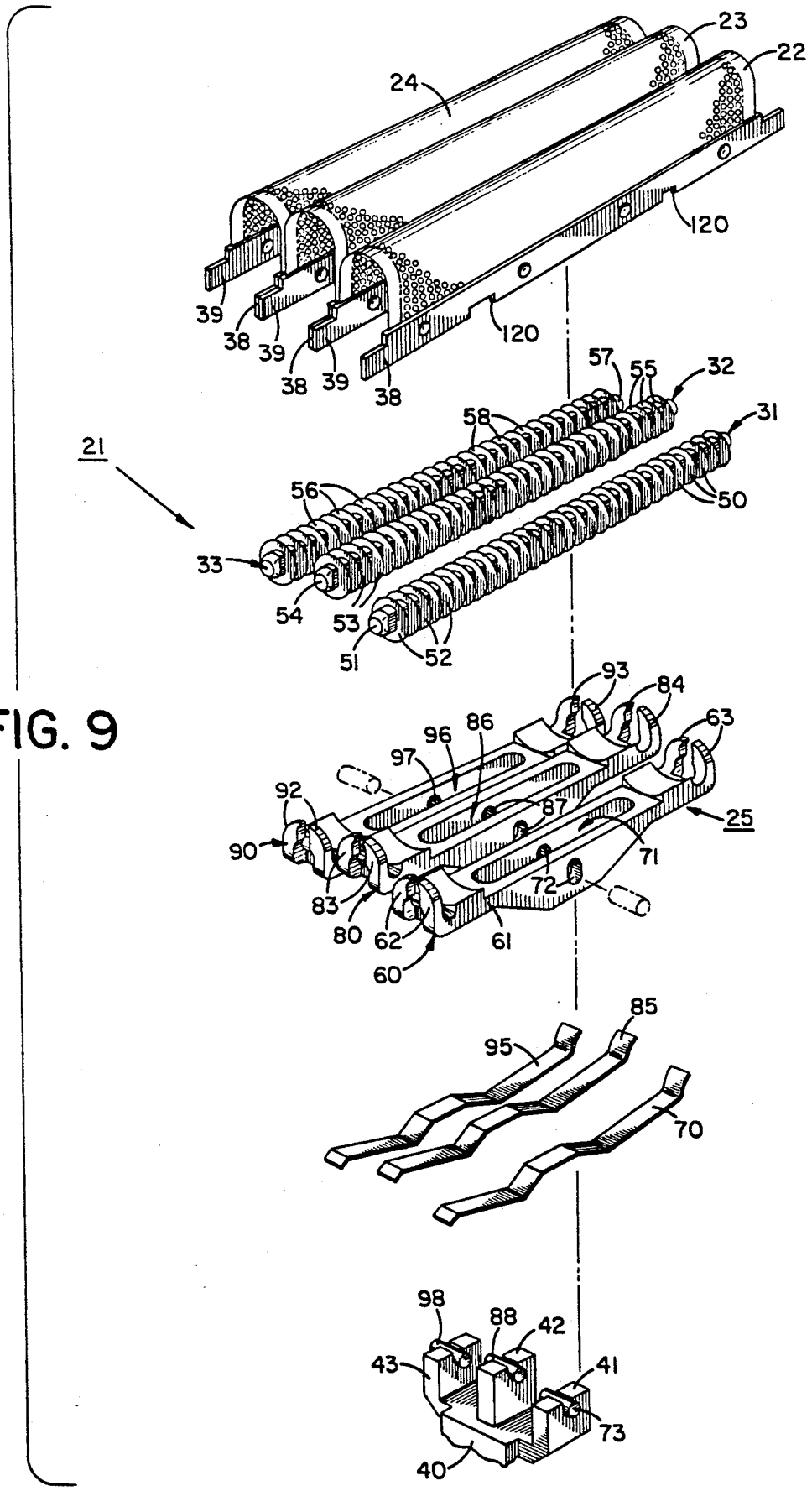
FIG. 9 is an exploded perspective view showing the assembly and construction details for the foil member and multiple cutting blade assemblies of the present invention.

In completing the assembly of this embodiment of improved cutting system 21, separate and independent support members are employed for securely maintaining and properly positioning blade assemblies 32 and 33. As shown in FIGS. 9 and 11, blade assembly 32 is securely maintained and held in the precisely desired position for reciprocating frictional interengagement with foil member 23 by blade assembly support member 80.

As detailed above in reference to blade assembly support member 60, blade assembly support member 80 comprises a support base 81 on which is mounted at its opposed terminating ends finger members 83—83 and 84—84. Upstanding finger members 83—83 and 84—84 are positioned relative to each other peripherally surrounding and lockingly engaging holding rod 54 of blade assembly 32. In this way, cutting blades 53 of blade assembly 32 are securely positioned and maintained in the desired location.

In order to assure that cutting blades 53 of blade assembly 32 are maintained in the precisely desired position in frictional interengagement with the inside surface of foil member 23, elongated leaf-spring member 85 is mounted in blade assembly support member 80, contacting the underside elongated cantilevered arms thereof. This assures that finger members 83—83 and 84—84 are continuously biased upwardly, along with the entire support member 80.

In order to accommodate and position leaf-spring 85 in the desired location, support member 80 incorporates a cavity 86 within which spring member 85 is retained. In addition, pin receiving slot 87 is formed in support base 81 of support member 80 extending on both sides of cavity 86. This enables locking pin 88 of support post 42 to securely position and pivotally retain blade assembly support member 80 in the precisely desired location for movement with support post 42 of drive pin 40. By employing this construction, blade assembly support member 80 and blade assembly 32 provide the desired reciprocating movement in cooperative interengagement with foil member 23, while also possessing the pivotal flexibility and translational movement detailed above in reference to blade assembly support member 60.

In completing the construction of this embodiment and in providing secure, supporting, flexible and movable retention of blade assembly 32, multiple blade supporting system 25 of this invention comprises a blade assembly support member 90, constructed in a manner substantially identical to support members 60 and 80, detailed above. As shown in FIGS. 9 and 11, blade assembly support member 90 comprises a support base 91 to which upstanding, juxtaposed, spaced, finger members are mounted on opposed ends thereof.

In this embodiment, finger members 92—92 are mounted at one end of support base 91, while finger members 93—93 are mounted at the opposed end of support base 91. In this way, the desired, secure, retained, interengagement of holding rod 57 of blade assembly 33 is provided and the precisely desired, secure, holding positioning and movement of blade assembly 33 is attained.

In order to maintain blade assembly support member 90 in the desired position, elongated leaf-spring 95 is securely mounted therewith, retained in cavity 96 formed in support base 91. In addition, support base 91 also incorporates pin-receiving slot 97 extending through support base 91 on both sides of cavity 96. Finally, blade assembly support member 90 is securely mounted to posts 43 by employing locking pin 98. In this way, support member 90 possesses the precisely desired axial pivotability about the axis of pin 98 as well as the desired translational movement, as detailed above in reference to blade assembly support member 60.

By employing the multiple blade supporting system 25 detailed above, the desired inherent flexibility and continuous, biased, contacting interengagement of blade assemblies 31, 32 and 33 with foil members 22, 23, and 24 is attained, and a substantially improved shaving system is realized.

Figure 14:
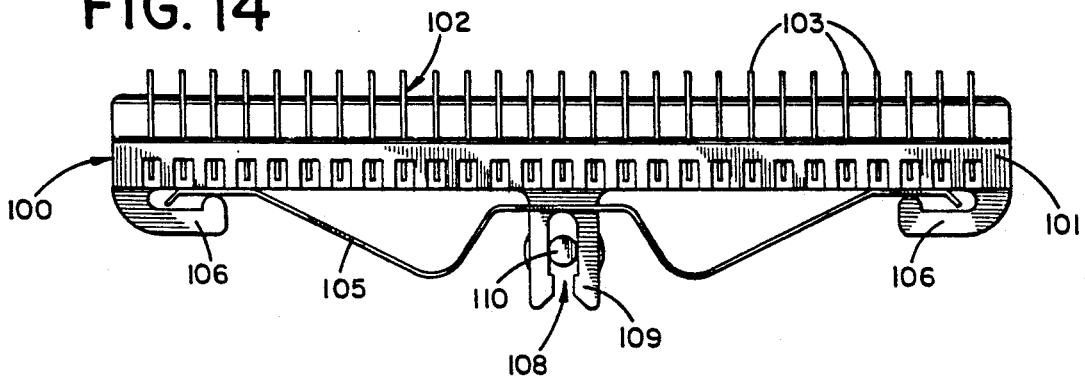
FIG. 14 is a side elevation view of an alternate embodiment of a cutting blade assembly in accordance with the present invention.

In addition to the embodiments detailed above, various alternate constructions can also be employed to impart the desired pivotability and translational movement. One such alternate construction for the blade assembly supporting members is shown in FIG. 14. Although only one blade assembly support member is shown in detail, each of the other blade assembly support members of the multiple blade supporting system 25 of this invention would employ substantially identical constructions.

As shown in FIG. 14, blade assembly support member 100 comprises elongated support base 101 which comprises a substantially U-shaped construction for receiving and holding blade assembly 102. In this construction, blade assembly 102 comprises a plurality of cutting blades 103 which are mounted in juxtaposed, spaced, cooperating relationship with each other, supportingly maintained by support base 101. In this construction, support base 101 is constructed for receiving and maintaining the plurality of cutting blades 103 in slots or holding zones formed in support base 101, thereby assuring that the entire elongated blade assembly 102 is maintained in the precisely desired position for contacting the foil member with which it cooperates.

In addition, an elongated leaf-spring member 105 is mounted along the bottom surface of support base 101 for biasingly maintaining support member 100 and blade assembly 102 in contacting engagement with the foil member with which it cooperates. Furthermore, leaf-spring member 105 maintains the cantilevered arms of base 101 in a raised position, thereby further assuring and providing the desired continuous contacting interengagement between blade assembly 102 and the cooperating foil member.

As shown in FIG. 14, leaf-spring member 105 is maintained in position by locking fingers 106, which are mounted at opposed ends of support base 101. Furthermore, support base 101 also incorporates an elongated openended slot 108 formed on extension post 109 of support base 101.

In this embodiment, extension post 109 is constructed for cooperating mounted interengagement with a movable drive pin or support post (not shown), in which is securely mounted a locking pin 110. By sliding open ended slot 108 over pin 110, in order to securely capture pin 110 in slot 108, mounted interengagement of support member 100 with the drive pin of the shaver assembly is attained. In this way, blade assembly support member 100 and blade assembly 102 are able to move in the desired reciprocating manner.

Furthermore, by employing this alternate construction, blade assembly support member 100 is movably mounted to the drive pin while also being capable of axial pivoting movement above post 110 and translational movement is limited only by the length of elongated open slot 108. In this way, this alternate construction provides the precisely desired axial pivotability and vertical translation desired for assuring continuously, contacting, flexible interengaged cooperation between blade assembly 102 and its associated foil member.

As is apparent from the disclosure provided, a plurality of alternate constructions can be employed for securely maintaining a blade assembly in continuous contacting engagement with its cooperating foil member. Although the embodiments detailed above represent the preferred embodiments, alternate constructions can be employed without departing from the scope of the present invention.

In employing the multiple cutting system of this invention, it has been found that anchoring some or all of the foil members can be desirable to reduce unnecessary wear or noise. However, in some certain circumstances, depending upon the dimensional tolerances employed, anchoring of the foil members may not be required, since the friction fit in the retention of the foil members in the desired location may be sufficient to prevent movement or displacement of the foil members after long-term use. However, if anchoring is desired, such anchoring can be attained in a plurality of alternate constructions.

One such construction is evident from FIG. 9, wherein foil member 22 is depicted as incorporating a plurality of notches 120 formed in end plate 38 of foil member 22. Each of the notches 120 is constructed for cooperatingly engaging an outwardly extending tab zone formed on the inside surface of the guard/cover support base for mating engagement therewith. In this way, longitudinal movement of foil member is prevented.

Preferably, similar notches 120 would be formed in end plate 39 of foil member 24 in order to prevent foil member 24 from longitudinal movement in a manner similar to foil member 22. In addition, if desired, vertical recesses can be formed in end plate 39 of foil member 22 as with end plate 38 of foil member 24, which would mate with cooperating ridges formed in the guard-/cover support base. Similarly, end plates 38 and 39 of foil member 23 would also incorporate similar vertical recesses for preventing axial movement of foil member 23.

Although the use of notches 120 or similar vertical recesses in end plates 38 and 39 may be employed for preventing axial or longitudinal movement of the foil members, alternate constructions may be employed for assuring that foil members 22, 23 and 24 are completely incapable of unwanted longitudinal movement. One alternate embodiment for preventing such movement is depicted in FIG. 9, wherein end plate 39 of foil member 22 is depicted as being affixed to end plate 38 of foil member 23, while end plate 39 of foil member 23 is similarly affixed to end plate 38 of foil member 24. By employing this mounted, interconnected foil construction, installation of foil members 22, 23 and i4 is enhanced and unwanted movement of foil member 23 is prevented by merely incorporating notches 120 in end plate 38 of foil member 22 and end plate 39 of foil member 24. With these two foil members prevented from movement, foil member 23 would also be longitudinally immovable due to its bonded interconnection with its two adjacent, anchored foil members.

Figure 15:
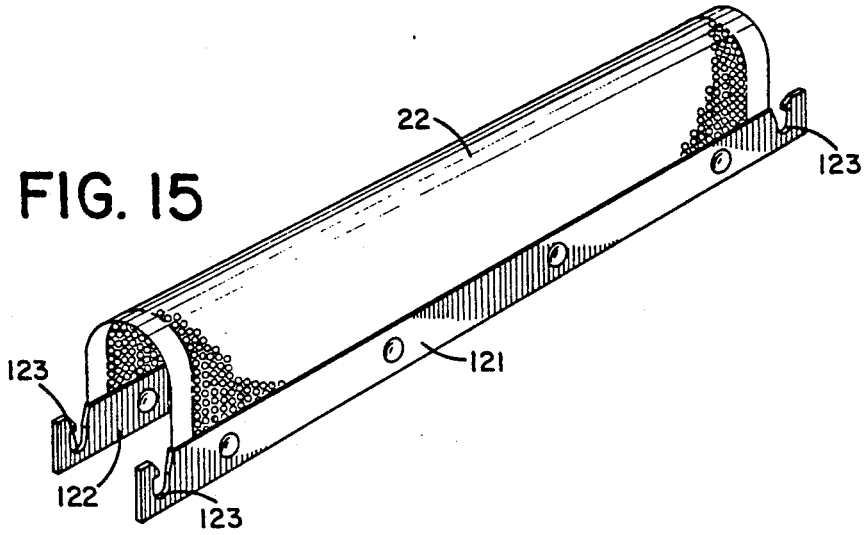
FIG. 15 is a perspective view depicting an alternate construction for a foil member in accordance with this invention.

By referring to FIG. 15, along with the following disclosure, a further alternate construction for preventing unwanted longitudinal movement of the foil members is provided. In this embodiment, foil member 22 is constructed with end plate 121 and 122 mounted at opposed ends thereof, with each of the end plates 121 and 122 incorporating a hook construction 123 at each opposed end.

By constructing end plates 121 and 122 with hook means 123 integrally formed at each opposed end thereof, hook means 123 are able to interconnect with retaining members formed in the guard/cover support base. In this way, longitudinal movement of foil member 22 is prevented and assurance is provided that foil member 22, once mounted in the guard/cover support base, is positively retained in the precisely desired locked position. By similarly constructing foil members 23 and 24 with substantially identical end plates, each of the foil members is independently mounted to the guard/cover support base with complete assurance that longitudinal movement is completely prevented.

Figure 16:
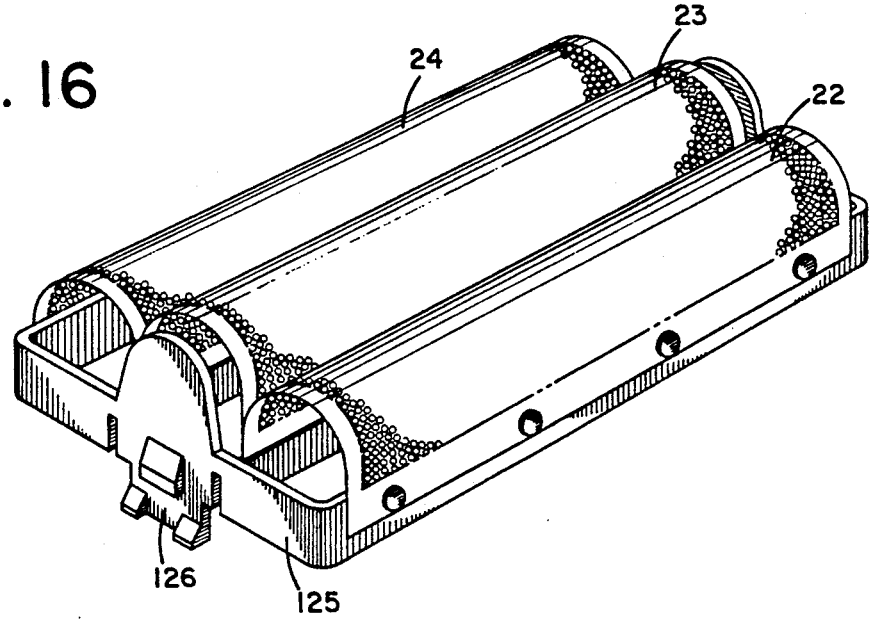
FIG. 16 is a perspective view depicting a still further embodiment for the foil members and mounting systems therefor in accordance with this invention.

In FIG. 16, a still further embodiment of this invention for preventing unwanted longitudinal movement of foil members 22, 23 and 24 is fully depicted. In this embodiment, foil members 22, 23 and 24 are securely affixed to a retaining base 125 which is removably mountable to a guard/cover support base. As depicted in FIG. 16, retaining member 125 incorporates a locking tab 126 which matingly connects with a cooperating recess formed in the associated guard/cover support base in order to position retaining base 125 and foil members 22, 23 and 24 in the precisely desired location, while also enabling retaining base 125 to be quickly and easily removed, whenever foil members 22, 23 and 24 need to be replaced.

By providing a retaining member 125 to which foil members 22, 23 and 24 are each individually securely affixed, unwanted shifting longitudinal movement of the foil members is eliminated and the desired secure, retained immovably positioning of foil members 22, 23 and 24 is provided.

Figure 18:
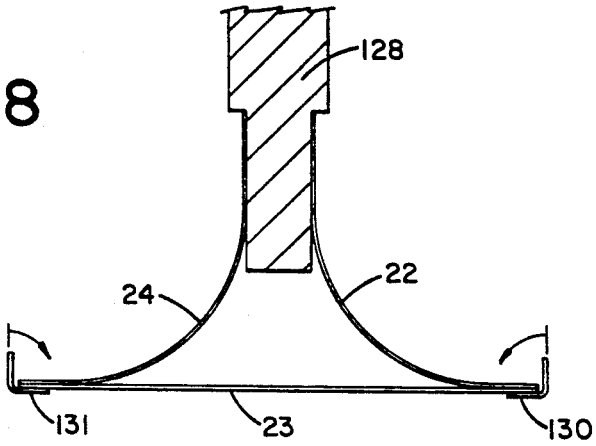
FIG. 18 is a cross-sectional side elevation view of an assembly system for manufacturing the multiple foil member construction depicted in FIG. 17.
Figure 17:
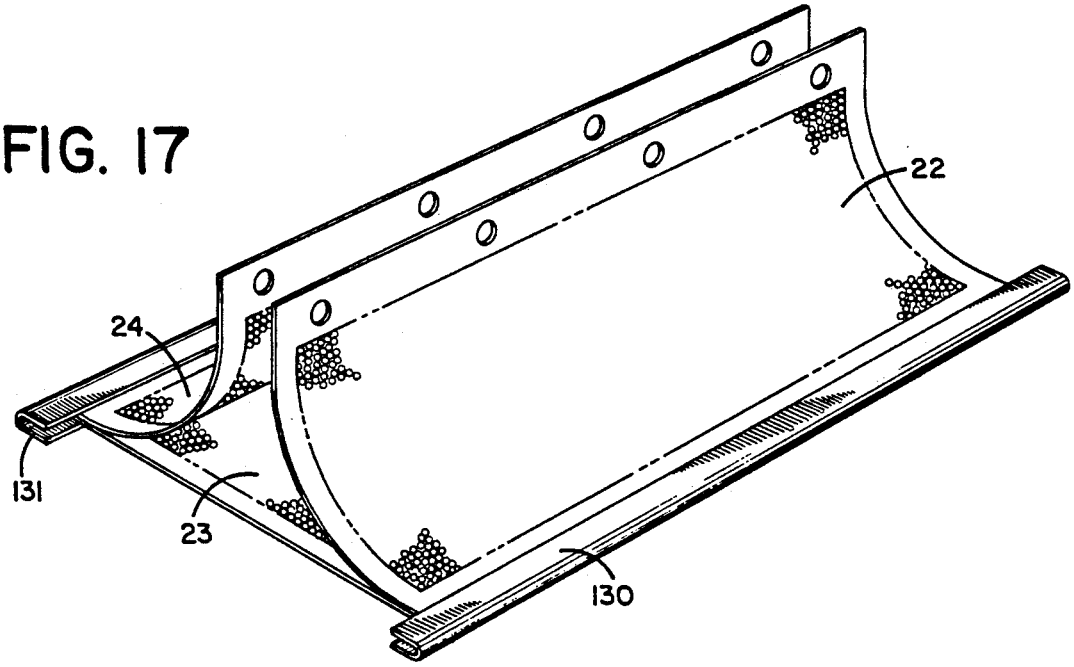
FIG. 17 is a perspective view depicting a further alternate embodiment for assembling the multiple foil members of the present invention.

Finally, in FIGS. 17 and 18, an alternate construction for securely affixing foil members 22, 23 and 24 to each other in order to form an integral unitary construction is provided. In addition to providing a single integral construction, wherein the side edges of foil members 22 and 24 may be restrained by notches, a unique construction method is provided for manufacturing a multiple foil member construction.

In this embodiment, one terminating edge of each foil member 22 and 24 is mounted on opposed sides of holding tool 128, in a manner which allows the other terminating edge of foil member 22 and foil member 24 to extend therefrom for being brought into contacting engagement with the opposed terminating edges of foil member 23. As depicted in FIG. 18, once foil members 22 and 24 have been placed in the desired position with foil members 22 and 24 in overlying contacting engagement with foil member 23, end plate 130 is clamped to the terminating edges of foil members 22 and 23, while end plate 131 is clamped to the terminating edges of foil member 24 and foil member 23.

In this way, once manufactured, as depicted in FIG. 17, a unitary construction is obtained, wherein foil members 22, 23 and 24 are all securely integrally interconnected with each other, providing an integral construction which is more easily inserted into the desired retained position in the guard/cover support base. Furthermore, by incorporating slot means in the end plates mounted to the free ends of foil member 22 and foil member 24, the entire assembly can be securely retained in the associated guard/cover support base, as detailed above, in order to assure that longitudinal movement of the foil members individually or in combination is prevented.

It will thus be seen that the objects set forth above, among those made apparent from the preceding description, are efficiently attained and, since certain changes may be made in the above article without departing from the scope of the invention, it is intended that all matter contained in the above description, or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what I claim as new and desire to secure by Letters Patent is:

1. An improved cutting system constructed for mounted interconnected engagement with an electric dry shaver and comprising A. an apertured foil member mounted to the electric dry shaver and comprising at least three separate and independent arcuate zones, each of said arcuate zones being capable of flexible movement independently of adjacent arcuate zones;

B. at least three separate and independent blade assemblies, each being mounted for reciprocating movement and supportingly maintained in sliding, frictional interengagement with one surface of one of said arcuate zones of the apertured foil member, for cooperating therewith to provide the desired cutting action; and C. at least three separate and independent blade assembly support members mounted for side-to-side reciprocating movement, and each comprising a. blade assembly holding means for supportingly engaging one of the blade assemblies and maintaining the blade assembly in contacting frictional engagement with one of the arcuate zones of the foil member, b. biasing means for continuously urging the blade assembly into contact with the arcuate zone of the foil member, and c. mounting means for securely affixing the support member to the shaver, and enabling the support member to arcuately pivot about a first axis and translationally move in its entirely along a second axis perpendicular to the first axis.

2. An electric dry shaver comprising:

A. a housing;

B. at least three, separate, arcuately curved, apertured foil members removably mounted to the housing;

C. at least three blade assemblies, each securely mounted with the housing for reciprocating movement relative thereto and cooperatively associated with one of said arcuately curved foil members for contacting engagement with one surface of said foil members; and D. at least three separate and independent blade assembly support members, each being mounted in the housing for movement relative thereto and comprising a. blade assembly holding means for cooperative, support holding interengagement with one of said blade assemblies for maintaining the blade assembly in frictional contacting interengagement with one of said foil members;

b. biasing means for continuously urging and maintaining the blade assembly in contact with the foil member; and c. mounting means securely affixing the support member to the shaver while enabling the support member to arcuately pivot about a first axis while also being translatably movable in its entirety along a second axis substantially perpendicular to the first axis;

whereby an improved cutting system is attained for electric dry shavers which is capable of providing substantially enhanced cutting capabilities while also providing a construction wherein virtually all shaving conditions are capable of being easily handled.

3. The electric shaver defined in claim 2, wherein at least one of said foil members comprises a thickness different from the thicknesses of the other foil members.

4. The electric dry shaver defined in claim 2, wherein at least one of said separate and independent foil members is further defined as comprising an apertured configuration different from the apertured configuration of the other foil members.

5. The electric dry shaver defined in claim 2, wherein at least one of said foil members is further defined as comprising a radius of curvature different from the radii of curvature of the other foil members.

6. The electric dry shaver defined in claim 2, wherein each of said foil member is further defined as being separately and independently removably mounted to the shaver for assuring complete independence of assembly and disassembly.

7. The electric dry shaver defined in claim 6, wherein each of said separate and independent foil members is further defined as comprising a mounting plate securely affixed to the opposed edges of the foil member, with said mounting plate constructed for frictional interengagement with the housing for securely positioning and removably affixing the foil member in the desired location therewith.

8. The electric dry shaver defined in claim 7, wherein a separate and independent mounting plate is mounted at each longitudinal edge of each foil member and each mounting plate is further defined as comprising substantially flat extension arms at each opposed end thereof, constructed for frictional interengagement with the housing for securely retaining each of the foil members therein.

9. The electric dry shaver defined in claim 7, wherein the mounting plate is further defined as comprising hook means formed at each opposed end thereof, constructed for secure locking interengagement with hook receiving means of said housing for securely mounting and affixing each of the foil members to the housing for secure retention therein.

10. The electric dry shaver defined in claim 7, wherein the mounting plates of the foil members are further defined as being securely bonded to adjacent foil members for establishing a substantially continuous integrally connected foil member having a plurality of arcuate zones.

11. The electric dry shaver defined in claim 2, wherein said separate, arcuately curved, apertured foil members are defined as being aligned in a substantially continuous, elongated, side-to-side construction wherein each foil member contacts an adjacent foil member along at least one of its terminating longitudinally extending edges and a single mounting plate is securely affixed to each of said contacting longitudinally extending edges, thereby securely affixing adjacent foil members to each other along at least one terminating edge thereof, whereby a substantially continuous, array of independent arcuately curved aperture foil members is attained all of which are integrally connected to each other along at least one longitudinally extending terminating edge thereof.

12. The electric dry shaver defined in claim 2, wherein each of said blade assemblies is further defined as comprising a plurality of independent cutting blades supportingly retained in juxtaposed, spaced, parallel relationship with each other, and each of said blade assembly support members is further defined as comprising a pair of cantilevered arms extending therefrom for supportingly holding and maintaining the cutting blades of the blade assembly in the desired position in cooperative association with one of said arcuately curved foil members.

13. The electric dry shaver defined in claim 12, wherein each of said blade assembly support members is further defined as comprising spring means cooperatively associated therewith for biasingly contacting the cantilevered arms thereof and continuously urging the cantilevered arms and the entire blade assembly in a direction causing the blade assembly supported therein to be maintained in biased, contacting interengagement with the surface of one of the foil members.

14. The electric dry shaver defined in claim 13, wherein said shaver is further defined as comprising at least three separate upstanding support posts constructed for reciprocating movement relative to the shaver housing and each of the separate and independent blade assembly support members are further defined as being mounted to one of said upstanding support posts for controlled reciprocating movement therewith.

15. The electric dry shaver defined in claim 14, wherein each of said blade assemblies is further defined as being mounted to the support posts by a single, elongated locking pin extending through the support member and the post, thereby enabling the blade assembly support member to be pivotably movable about the axis defined by said locking pin.

16. The electric dry shaver defined in claim 15, wherein each of said blade assembly support members is further defined as comprising an elongated mounting slot within which said locking pin is securely affixed, thereby enabling each of said support members to be both pivotable about the axis of said locking pin, while also being movable in their entirety along an axis perpendicular to the axis of the locking pin.

17. The electric dry shaver defined in claim 16, wherein said elongated slot is further defined as comprising at least one narrowed open end, enabling said support member to be easily slid into locked interengagement with the locking pin, as well as removed therefrom, for ease of assembly and disassembly.

18. The electric dry shaver defined in claim 2, wherein the separate, arcuately curved aperture foil members are further defined as being mounted along each of their longitudinal terminating ends to a single foil holder constructed for mounted interengagement with the housing, thereby providing a foil assembly directly mountable to the housing which prevents any unwanted movement of the foil members.

19. The electric dry shaver defined in claim 18, wherein said foil member is further defined as being removably and replaceably mountable to the housing, by enabling ease of assembly as well as foil replacement whenever necessary.

* * * * *